US007096525B2

(12) United States Patent
Briere

(10) Patent No.: US 7,096,525 B2
(45) Date of Patent: Aug. 29, 2006

(54) CONVERTIBLE CRIB

(76) Inventor: Ronald William Briere, 314 S. Main St., Troutman, NC (US) 28166

( * ) Notice: Subject to any disclaimer, the term of this patent is extended or adjusted under 35 U.S.C. 154(b) by 138 days.

(21) Appl. No.: 10/510,902

(22) PCT Filed: Jul. 15, 2004

(86) PCT No.: PCT/US2004/022837

§ 371 (c)(1),
(2), (4) Date: Oct. 8, 2004

(87) PCT Pub. No.: WO2005/009174

PCT Pub. Date: Feb. 3, 2005

(65) Prior Publication Data

US 2005/0229306 A1 Oct. 20, 2005

Related U.S. Application Data

(60) Provisional application No. 60/487,549, filed on Jul. 15, 2003.

(51) Int. Cl.
*A47D 7/01* (2006.01)
*A47D 11/00* (2006.01)

(52) U.S. Cl. ..... 5/93.2; 5/2.1

(58) Field of Classification Search ..... 5/93.2, 5/2.1, 93.1, 53.1, 285
See application file for complete search history.

(56) References Cited

U.S. PATENT DOCUMENTS

| | | | | |
|---|---|---|---|---|
| 3,403,412 | A | 10/1968 | Gottfried et al. | |
| 3,979,783 | A | 9/1976 | Spencer | |
| 5,038,427 | A | 8/1991 | Golden | |
| 5,077,846 | A | 1/1992 | Wheeler, III et al. | |
| 5,163,190 | A | 11/1992 | Hwang | |
| 5,173,974 | A | 12/1992 | Proano et al. | |
| 5,715,551 | A | 2/1998 | Proano et al. | |
| 6,594,834 | B1 | 7/2003 | Fenty et al. | |
| 6,845,530 | B1 * | 1/2005 | Briere | 5/93.2 |

OTHER PUBLICATIONS

BONAVITA, Lifestyle Crib, Brochure, Date Unknown, 1 pg.

* cited by examiner

*Primary Examiner*—Alexander Grosz
(74) *Attorney, Agent, or Firm*—Adams Evans P.A.

(57) ABSTRACT

A crib, which is convertible to a plurality of other furniture pieces, has four legs, a front panel, a rear panel, two side panels, and two stabilizing posts. The stabilizing posts are positioned adjacent and parallel to the two legs supporting the front panel. Each stabilizing post is removably engaged to a leg, and is structurally independent of the front panel. All components of the crib can utilized when the crib is converted to another furniture piece, so that no components are discarded.

19 Claims, 17 Drawing Sheets

CONVERTIBLE CRIB

TECHNICAL FIELD AND BACKGROUND OF THE INVENTION

This is a national stage application of International Application No. PCT/US2004/022837, filed Jul. 15, 2004 which claims the benefit under 35 U.S.C. 119(e) of Provisional Application No. 60/487,549, filed Jul. 15, 2003.

This invention relates to a furniture piece that is convertible into a variety of pieces, including a crib, youth bed, day bed, full-size bed, and sofa. The invention is particularly designed to be initially used as a crib, and then later converted into other furniture pieces depending upon the needs of the user. The invention is designed such that all structural components can be utilized when converting from a crib to another piece.

A child will typically outgrow a crib by approximately the age of two years. In view of the relatively short time period for using a crib, it is generally desirable from a marketing standpoint to provide a crib that can be converted into other useful furniture pieces once the child has outgrown the crib.

The prior art includes cribs with four legs in which the front panel is removable from the rest of the crib in order to form a day bed. Another prior art crib includes six legs and can convert into a day bed and a full-size bed. However, in each of these prior art cribs, at least one major structural components is discarded upon converting the crib to another furniture piece resulting in a waste of materials. Furthermore, both of these prior art cribs can be used to form only one furniture piece at a time. These prior art designs are explained in detail, infra.

SUMMARY OF THE INVENTION

Therefore, it is an object of the invention to provide a furniture piece that can be converted from a crib to a variety of other furniture pieces, such as a youth bed, day bed, full-size bed, and sofa.

It is another object of the invention to provide a furniture piece that can be converted from a crib to other furniture pieces without discarding any major structural components.

These and other objects of the present invention are achieved in the preferred embodiments disclosed below by providing a crib which is convertible to another article of furniture having first, second, third and fourth interconnected panels defining an enclosure for supporting a base, and first, second, third and fourth legs for supporting the panels on a surface, the first and second legs supporting the first panel. The crib includes first and second stabilizer posts. The first stabilizer post is positioned parallel and proximate to the first leg, and the second stabilizer post positioned parallel and proximate to the second leg. The first and second stabilizer posts are sized to terminate at a point above the surface such that the stabilizer posts do not contact the surface. The first stabilizer post is connected to the second panel and the second stabilizer post is connected to the third panel. The first leg is releasably connected to the first stabilizer post, and the second leg is releasably connected to the second stabilizer post so that the crib is convertible to another furniture piece by disconnecting the first leg from the first stabilizer post and disconnecting the second leg from the second stabilizer post to remove the first panel, and positioning a base piece under the stabilizer posts so that the second, third and fourth panels are supported on the surface when the first and second legs are removed.

According to a preferred embodiment of the invention, the crib is convertible to a day bed, a youth bed, a full size bed and a sofa.

According to another preferred embodiment of the invention, the first panel is adapted for use as a component on another article of furniture when removed from the crib, so that all parts of the crib are utilized.

According to yet another preferred embodiment of the invention, the first panel defines a front panel, the second panel defines a rear panel, the third panel defines a left side panel, and the fourth panel defines a right side panel. The crib is converted to a day bed by disconnecting the first and second panels from the stabilizer posts.

According to yet another preferred embodiment of the invention, the crib has a length approximately equal to a width of a full size bed, and the first panel is can serve as a footboard for a full size bed when disconnected from the first and second legs so that all components of the crib are utilized when the crib is converted to a day bed.

According to yet another preferred embodiment of the invention, the crib includes first and second foot pieces for releasably connecting to bottom sides of the first and second stabilizer posts. The foot pieces sized to terminate at the surface when connected to the stabilizer posts, so that the stabilizer posts and the foot pieces support the second and third panels on the surface when the first and second legs are disconnected from the stabilizer posts.

According to yet another embodiment of the invention, a front railing can be connected to the stabilizer posts when the first and second legs are disconnected from the stabilizer posts to form a youth bed.

According to yet another preferred embodiment of the invention, the convertible crib includes front, rear, left and right interconnected panels defining an enclosure for positioning a base. The crib includes first, second, third, and fourth primary support members for supporting the base, and are connected to the left and right panels. The crib further includes first, second, third and fourth secondary support members releasably connected to the first, second, third and fourth primary support members, respectively. The secondary support members are connected to and support the front and rear panels. The crib is convertible to another furniture piece, such as a day bed, by disconnecting the first, second, third and fourth secondary support members from the first, second, third and fourth primary supports so that the front and rear panels are removed and the left and right panels are supported on the surface by the primary support members.

According to yet another preferred embodiment of the invention, the primary support members are first, second, third and fourth stabilizer posts, and the secondary support members are first, second, third and fourth legs. The first, second, third and fourth legs are releasably connected to the first, second, third and fourth stabilizer posts, respectively, so that the crib is convertible to another furniture piece by disconnecting the legs from the stabilizer posts to remove the front and rear panels, so that the left and right panels are supported on the surface when the legs are removed.

According to yet another preferred embodiment of the invention, the crib has a length approximately equal to a width of a bed, and the front panel is adapted to serve as a footboard for a bed when disconnected from the stabilizer posts, the rear panel is adapted for use as a headboard for the bed when disconnected from the stabilizer posts, whereby all components of the crib are utilized when the crib is converted to another article of furniture.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Prior Art

Figure 1:
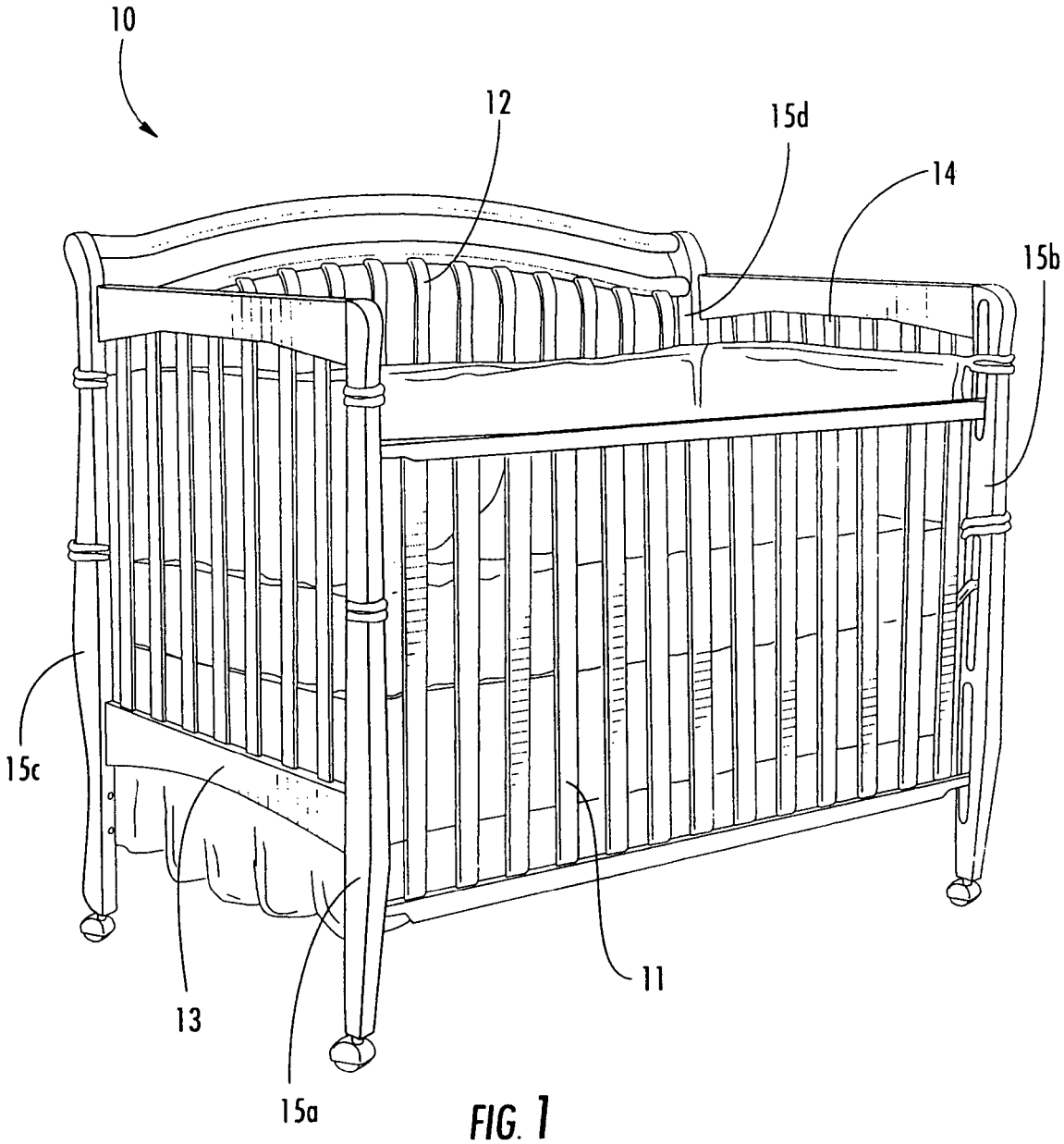
FIG. 1 (PRIOR ART)
FIG. 1 is a perspective view of a prior art crib.

Referring now specifically to the drawings, a prior art crib is illustrated in FIG. 1, and shown generally at reference numeral 10. The crib 10 comprises a front panel 11, a rear panel 12 and two narrower side panels 13, 14. The panels 11–14 are mounted on four legs 15*a*–*d*. The front panel 11 is removably engaged to the front legs 15*a*, 15*b*. When desired by the user, the crib 10 can be converted into a day bed by removing front panel 11. However, the utility of crib 10 is substantially limited in that it can be converted only to a day bed, and upon doing so the front panel 11 is discarded as it has no other function.

Figure 2:
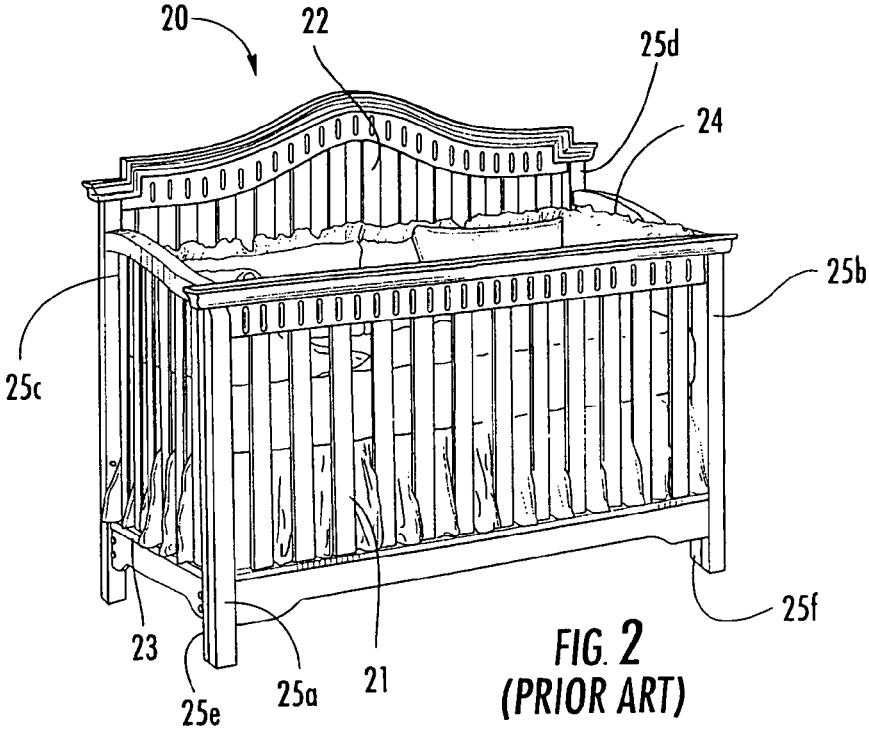
FIG. 2 (PRIOR ART)
FIG. 2 is a perspective view of another prior art crib.
Figure 2A:
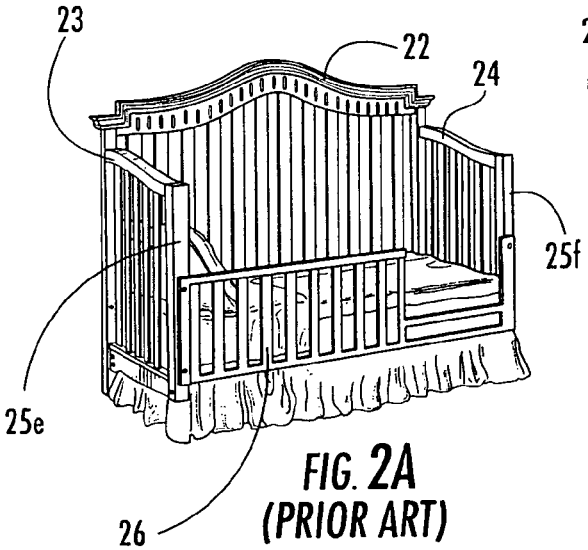
FIG. 2A (PRIOR ART)
FIG. 2A is a perspective view of the prior art crib shown in FIG. 2 converted into a toddler bed.
Figure 2B:
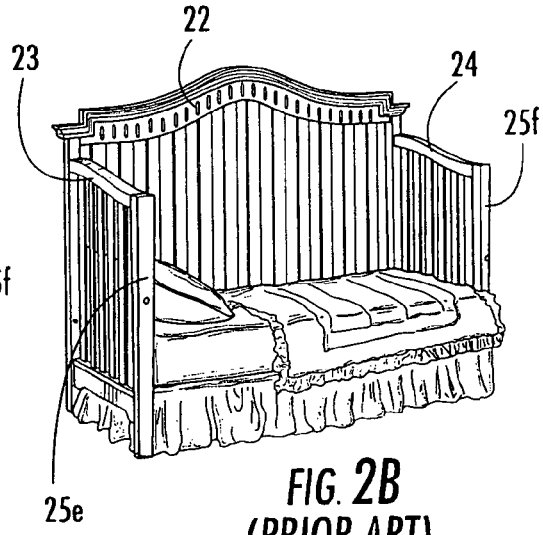
FIG. 2B (PRIOR ART)
FIG. 2B is a perspective view of the prior art crib shown in FIG. 2 converted into a day bed.
Figure 2C:
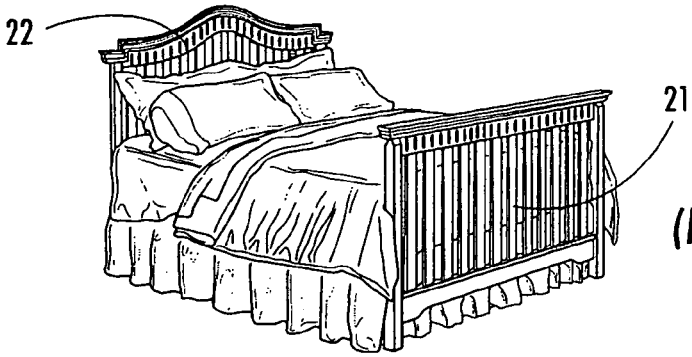
FIG. 2C (PRIOR ART)
FIG. 2C is a perspective view of the prior art crib shown in FIG. 2 converted into a full-size bed.
Figure 3:
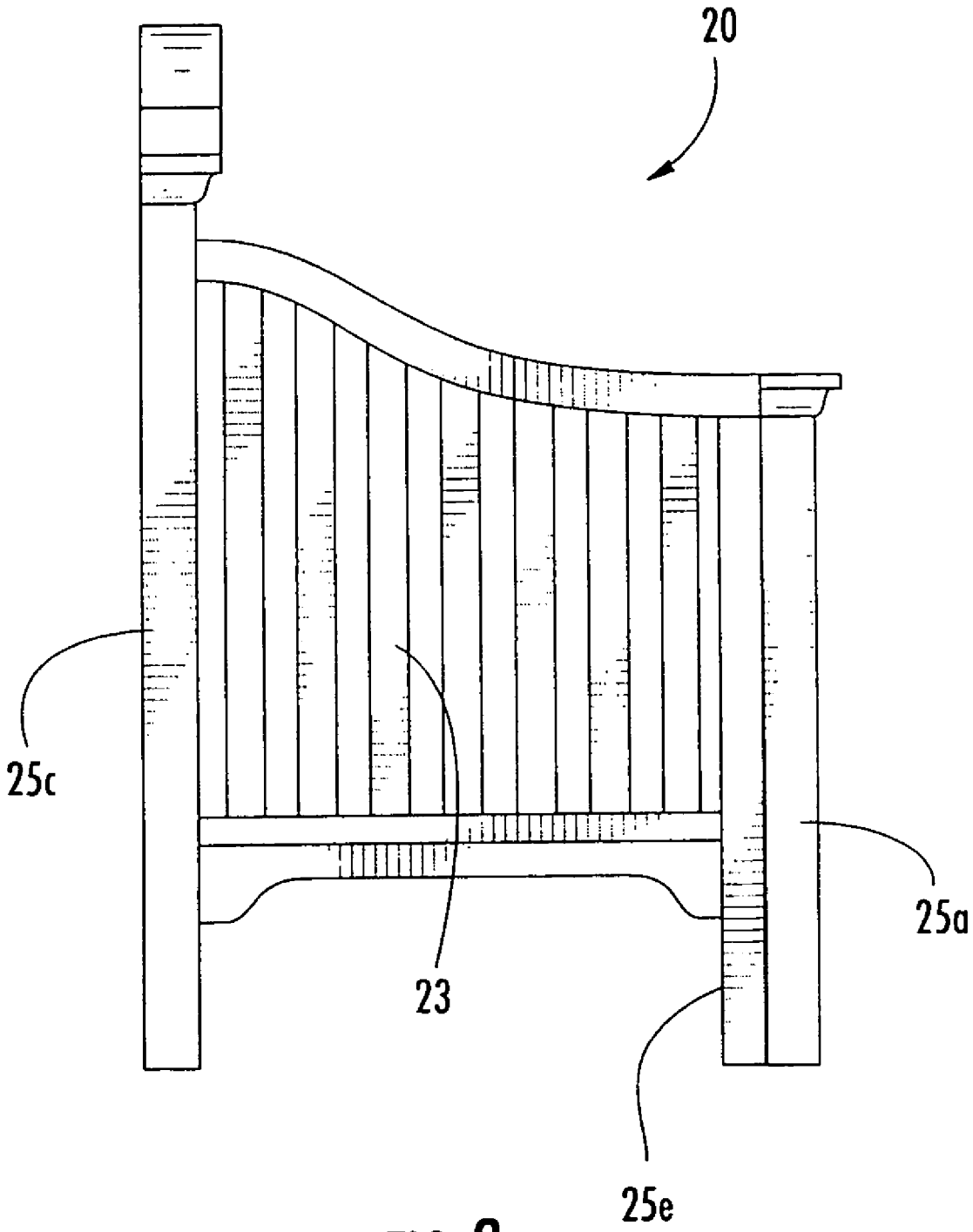
FIG. 3 (PRIOR ART)
FIG. 3 is a side elevation of the prior art crib shown in FIG. 2.

Another prior art crib is illustrated in FIG. 2, and shown generally at reference numeral 20. The prior art crib 20 comprises a front panel 21, a rear panel 22 and two smaller side panels 23, 24. The crib 20 includes six legs 25*a*–*f*. The front panel 21 is mounted on legs 25*a*, 25*b*, while the rear panel 22 is mounted on legs 25*c*, 25*d*. Legs 25*e*, 25*f* are directly behind and removably engaged to legs 25*a*, 25*b*, respectively. Side panel 23 is supported by legs 25*e* and 25*c*, as shown in FIG. 3, while the other side panel 24 is similarly supported by legs 25*f* and 25*d*. FIG. 2A shows the crib 20 converted into a toddler bed by removing front panel 21 and replacing it with a modified panel 26. FIG. 2B shows the crib 20 converted into a day bed by removing the front panel 21, and FIG. 2C shows the front panel 21 and the rear panel 22 removed from the crib 20 for use as a footboard and a headboard, respectively on a full–size bed. In all of its various configurations shown in FIGS. 2A–2C, at least one of the major structural components of the crib 20, is discarded, resulting in a substantial waste of materials. Furthermore, the crib 20 can provide only one of the various configurations at once.

Invention

Figure 4:
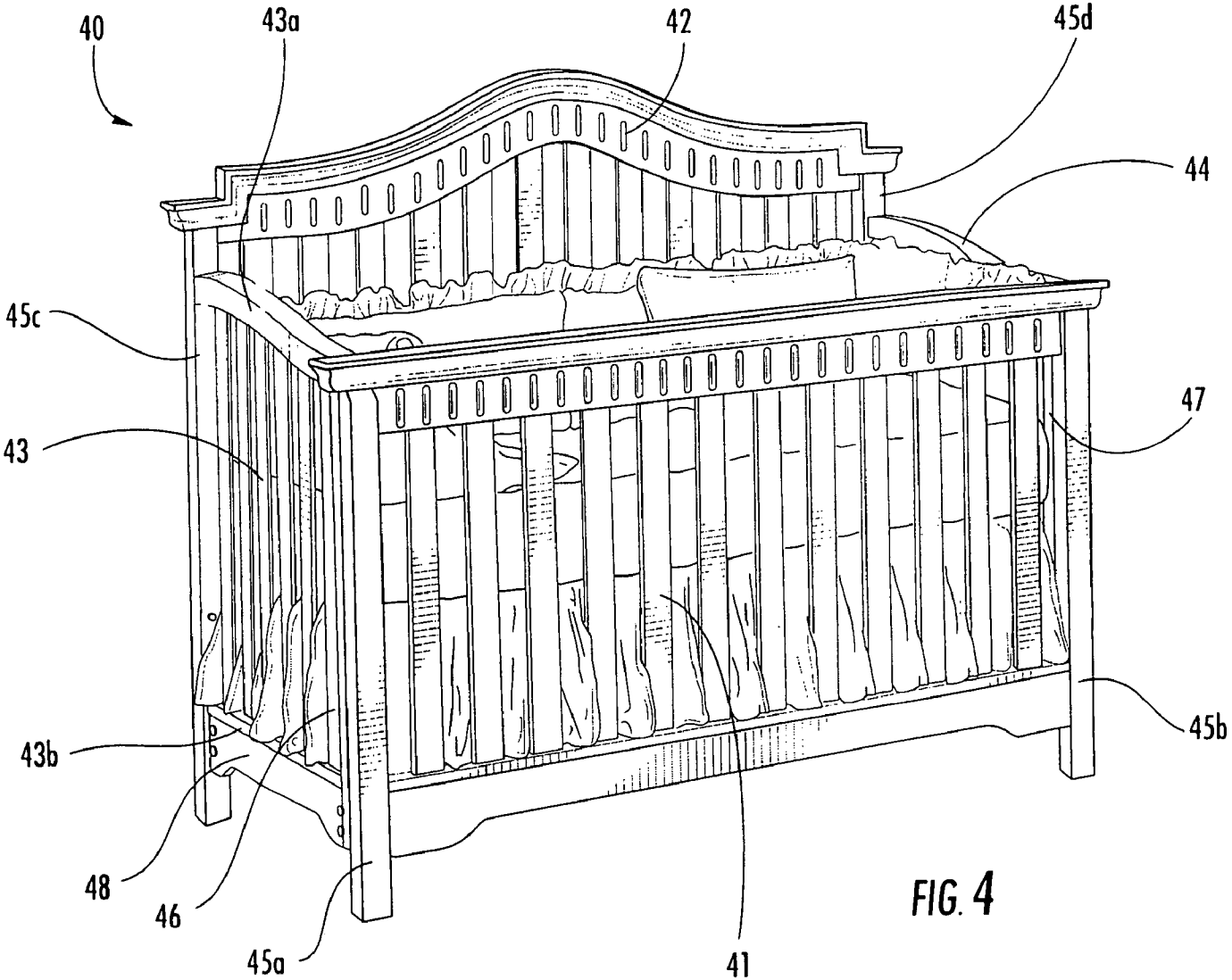
FIG. 4 is a perspective view of a convertible crib according to a preferred embodiment of the invention.
Figure 5A:
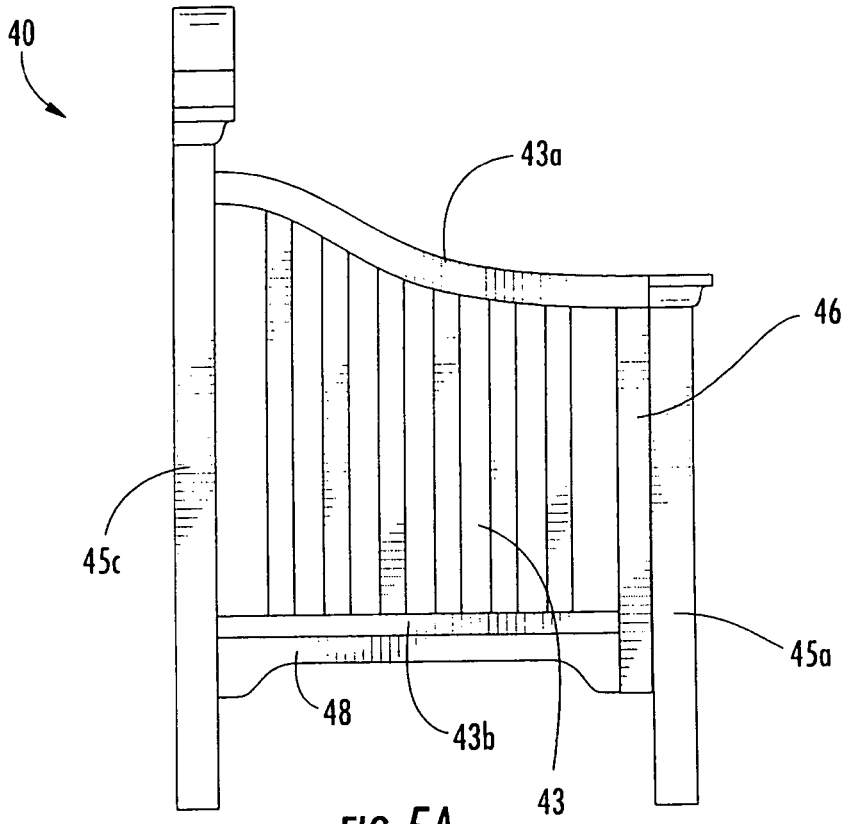
FIG. 5A is a side elevation of the crib of FIG. 4.
Figure 5B:
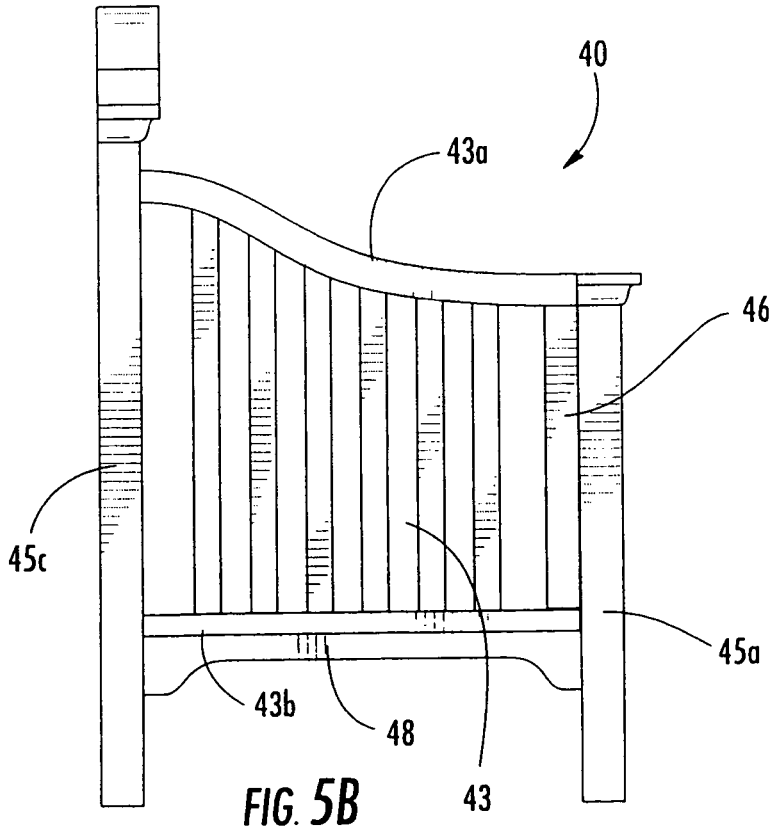
FIG. 5B is a side elevation of a convertible crib according to an other preferred embodiment of the invention

A preferred convertible crib according to the present invention is illustrated in FIG. 4 and shown generally at reference numeral 40. The crib 40 comprises a front panel 41, a rear panel 42 and two narrower side panels 43, 44, four legs 45*a*–*d*, and two stabilizer posts 46, 47. As shown in FIGS. 5A and 5B, side panel 43 includes a horizontally extending top side rail 43*a* and a horizontally extending bottom side rail 43*b* respectively. One of the stabilizer posts 46 extends vertically and connects the top side rail 43*a* to the bottom side rails 43*b*. The other side panel 44 is constructed identically to side panel 43, and therefore is not shown in similar detail. Likewise, the other stabilizer post 47 is configured within the crib 40 identically to stabilizer post 46. Side panel 44 includes a horizontally extending top side rail and a horizontally extending bottom side rail connected by stabilizer post 47.

As shown in FIGS. 4, 5A and 5B, the stabilizer posts 46, 47 are positioned adjacent to the front legs 45*a*, 45*b*, respectively. The front legs 45*a*, 45*b* are removably engaged to the stabilizer posts 46, 47, respectively, by any conventional connecting means, such as nuts and bolts. The rear legs 45*c*, 45*d*, supporting the rear panel 42, are removably engaged to side panels 43, 44, respectively. The front panel 41 is connected to the front legs 45*a*, 45*b*, or alternatively, the stabilizer posts 46, 47. In addition, an arched bottom piece 48 is attached below bottom side rail 43*b*. Likewise, an arched bottom piece (not shown) is attached below the bottom side rail (not shown) of the other side panel 44. FIG. 5A shows the stabilizer post 46 extending all the way to the bottom of the arched bottom piece 48, while FIG. 5B shows an alternative embodiment in which the stabilizer post terminates at the bottom side rail 43*b*.

Figure 6:
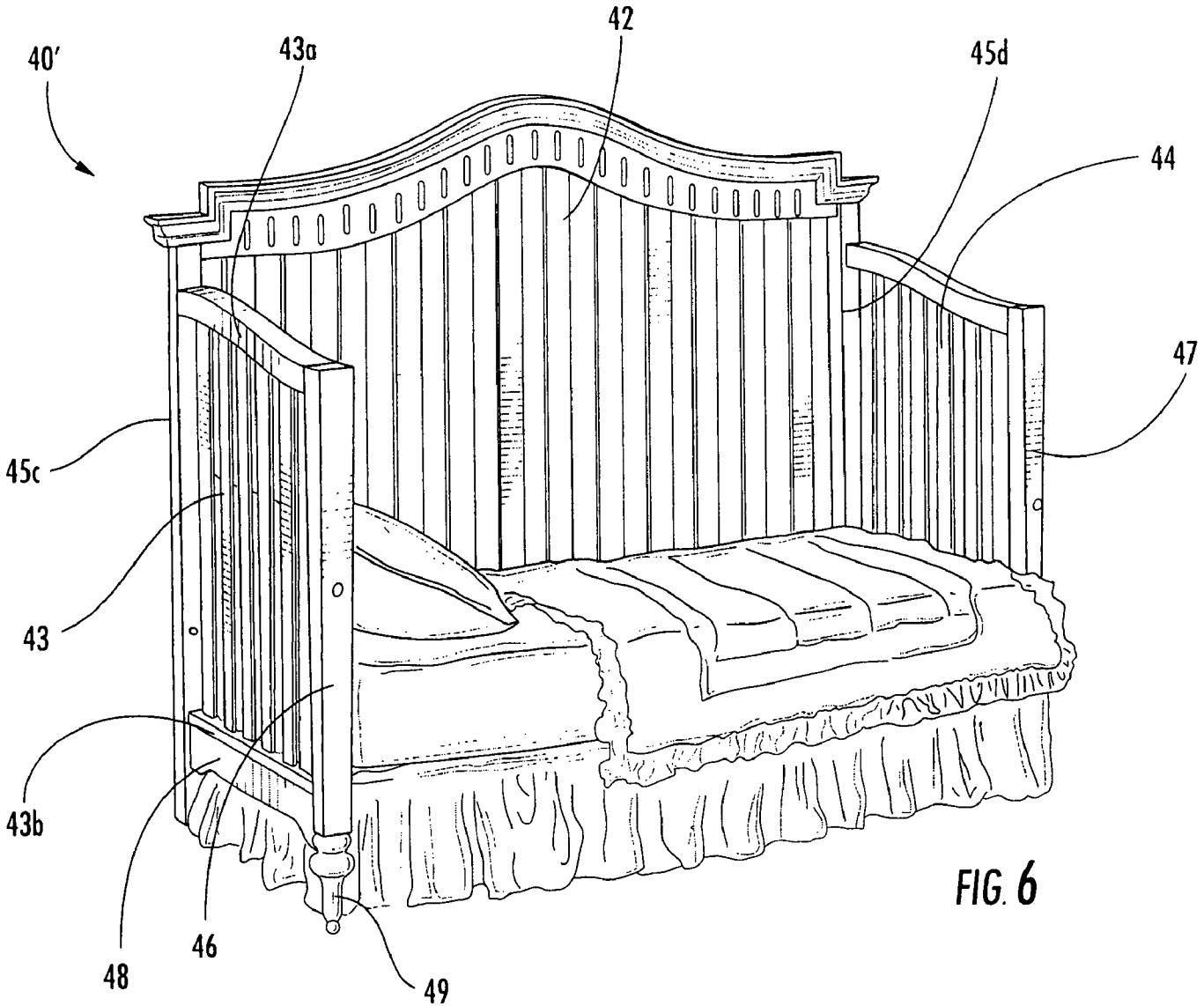
FIG. 6 is a perspective view of the crib of FIG. 4 shown converted into a day bed.
Figure 7A:
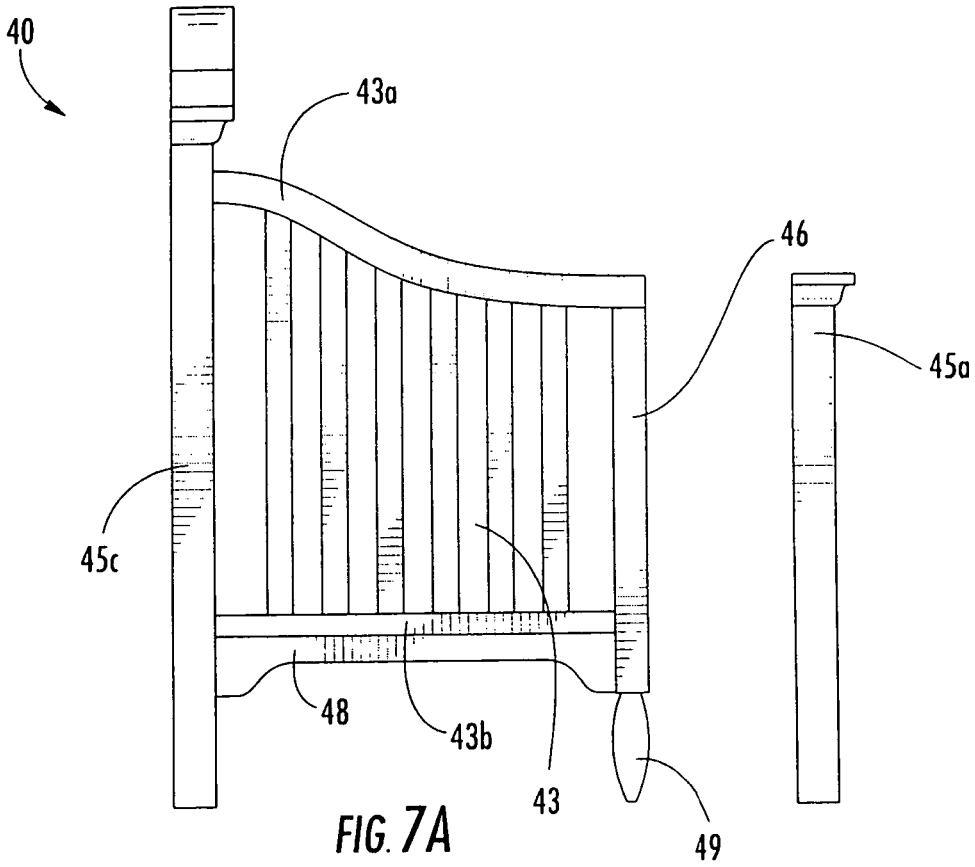
FIG. 7A is another side elevation of the crib of FIG. 4.
Figure 7B:
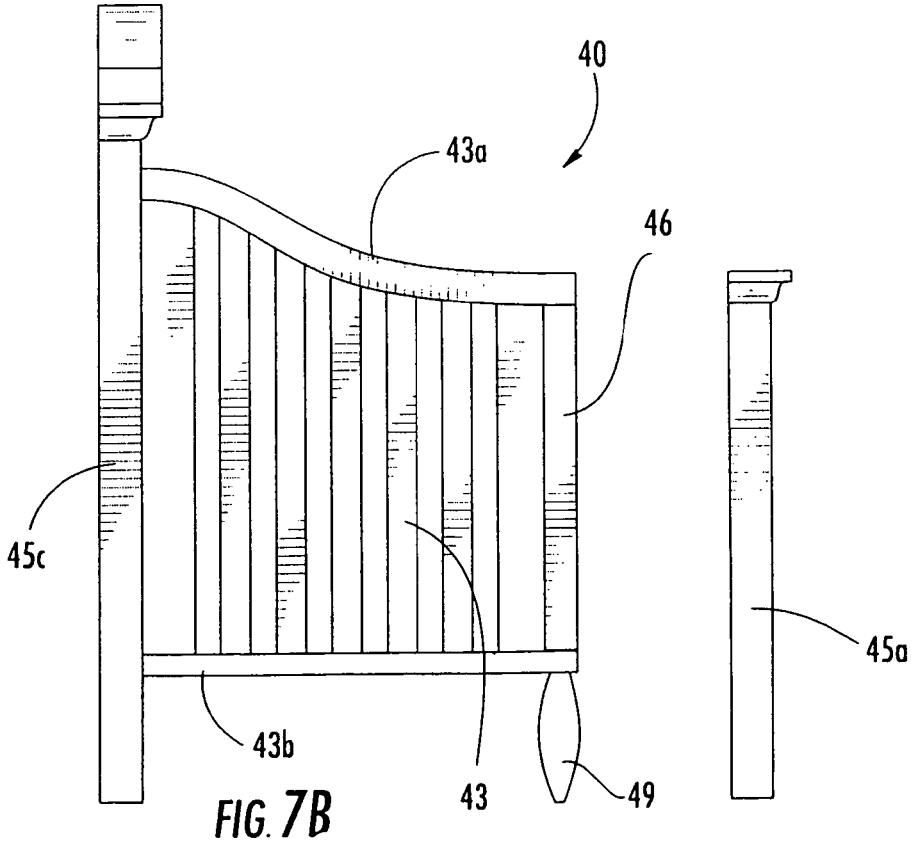
FIG. 7B is a side elevation of a convertible crib according to another preferred embodiment of the invention.
Figure 8:
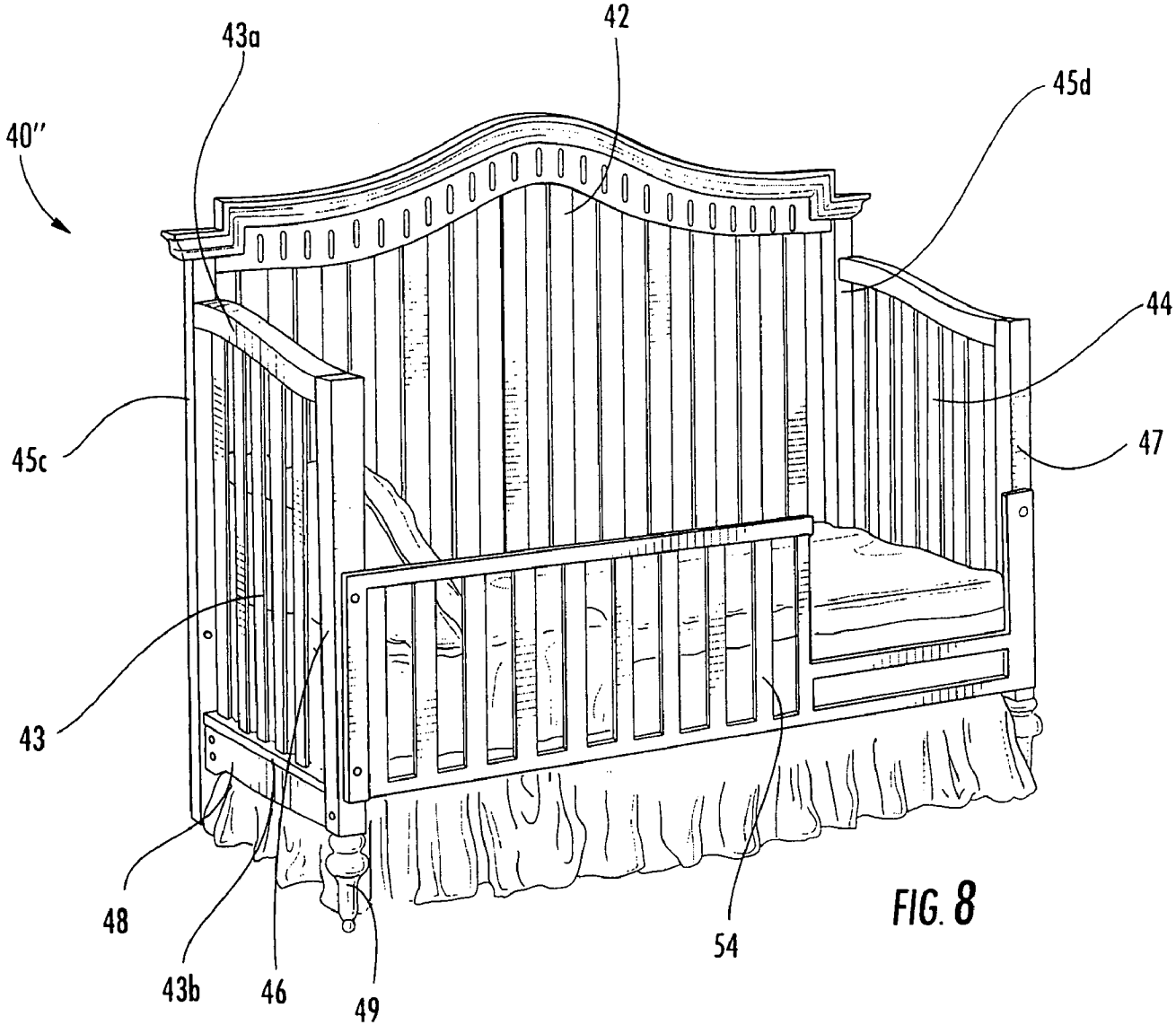
FIG. 8 is a perspective view of the crib of FIG. 4 shown converted into a toddler bed.

As shown in FIGS. 6, 7A and 7B, the crib 40 can be converted into a day bed 40' by disengaging the front legs 45*a*, 45*b* from the stabilizer posts 46, 47. The front panel 41 is removed, and foot pieces 49 are connected to the bottom of the stabilizer posts 46, 47. Similarly, the crib 40 can be converted into a toddler or youth bed 40" by adding a front railing 54 connected to the stabilizer posts 46, 47, as shown in FIG. 8.

Figure 9:
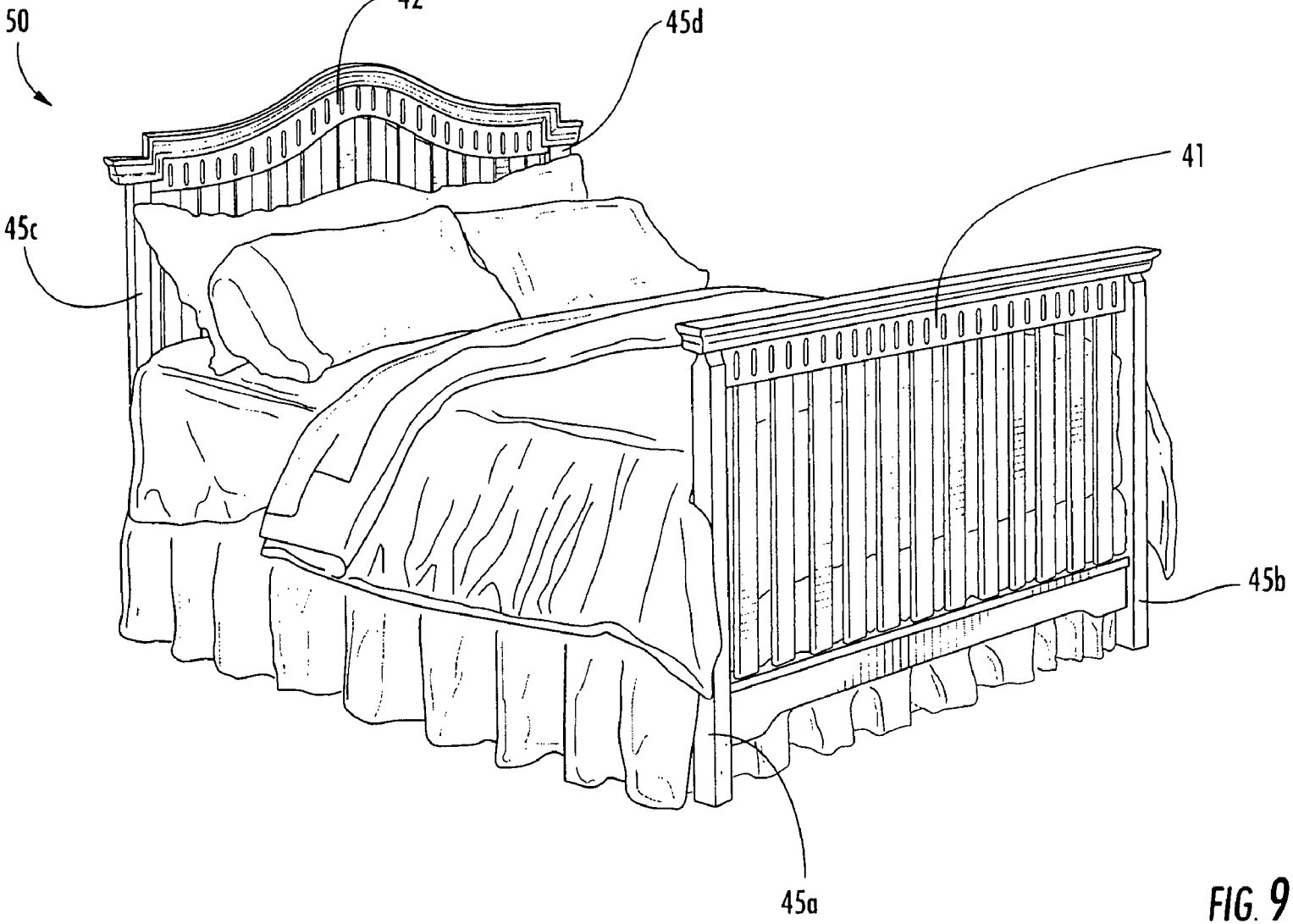
FIG. 9 is a perspective view of the crib of FIG. 4 shown converted into a full-size bed.

The length of the crib 40 is approximately equal to the width of a full-size bed. As such, the front panel 41 and the rear panel 42 can be removed from the rest of the crib 40, and used as a footboard and headboard, respectively, on a full-size bed as shown in FIG. 9. To remove the front panel 41, the front legs 45*a*, 45*b* are disconnected from the stabilizer posts 46, 47 as described above. The rear panel 42 is removed by disconnecting the rear legs 45*c*, 45*d* from the side panels 43, 44, respectively.

Figure 10:
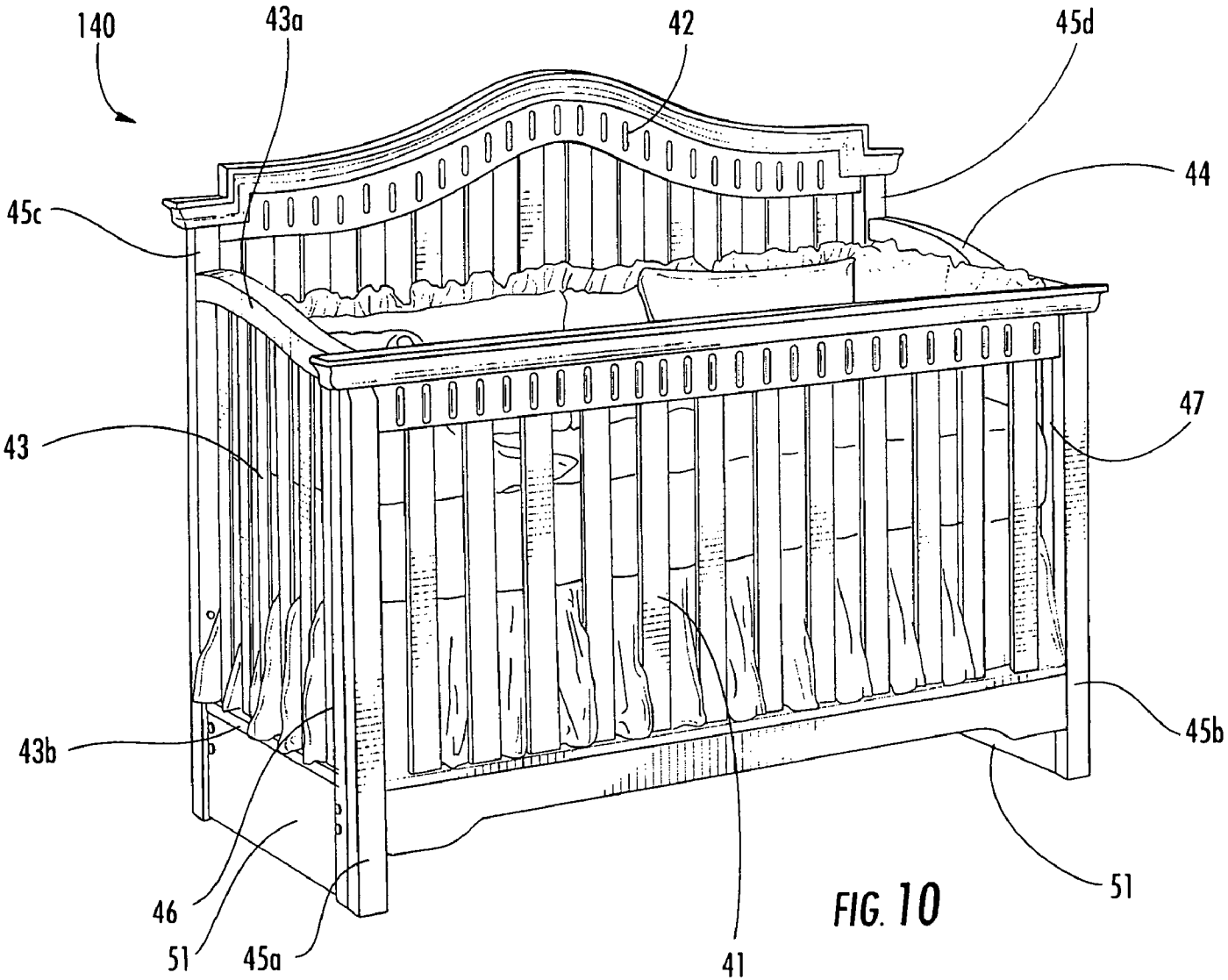
FIG. 10 is perspective view of a convertible crib according to yet another preferred embodiment of the invention.
Figure 11:
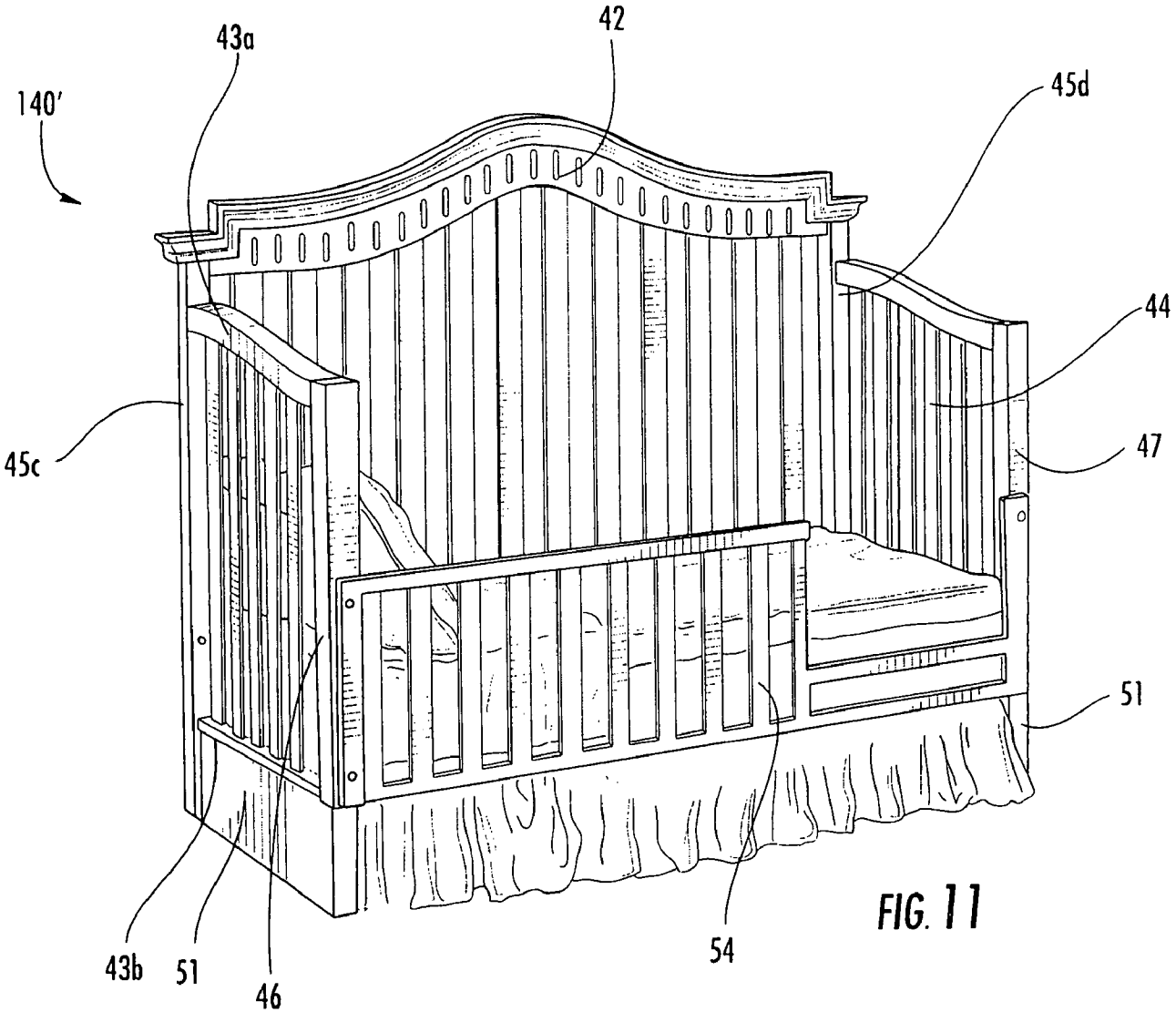
FIG. 11 is perspective view of the crib of FIG. 10 shown converted into toddler bed.

FIG. 10 shows an alternative embodiment of the invention as a crib 140 in which a bottom piece 51 is positioned below the bottom side rails of the side panels 43, 44 and is flush with the legs 45*a–d*. The bottom piece 51 eliminates the need for foot pieces 49 when legs 45*a*, 45*b* are removed, as shown in FIG. 11.

Figure 12:
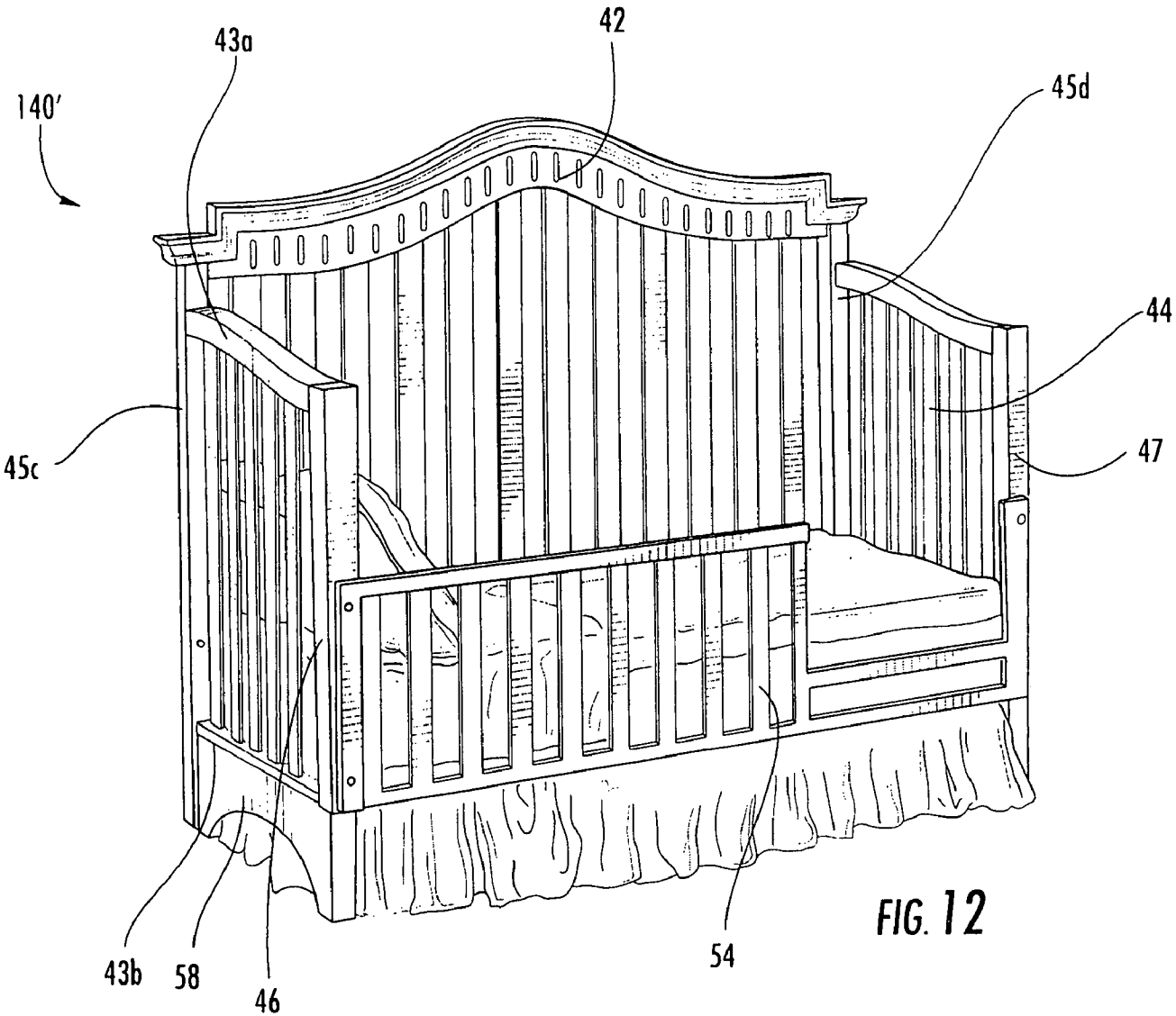
FIG. 12 is a perspective view of a crib according to yet another preferred embodiment of the invention.

FIG. 12 shows another embodiment of a crib 140' in which an arched bottom piece 58 is positioned underneath the bottom side rails and is flush with the legs 65*a–d* at its opposing ends. Bottom piece 58 also eliminates the need for foot pieces 49.

Figure 13:
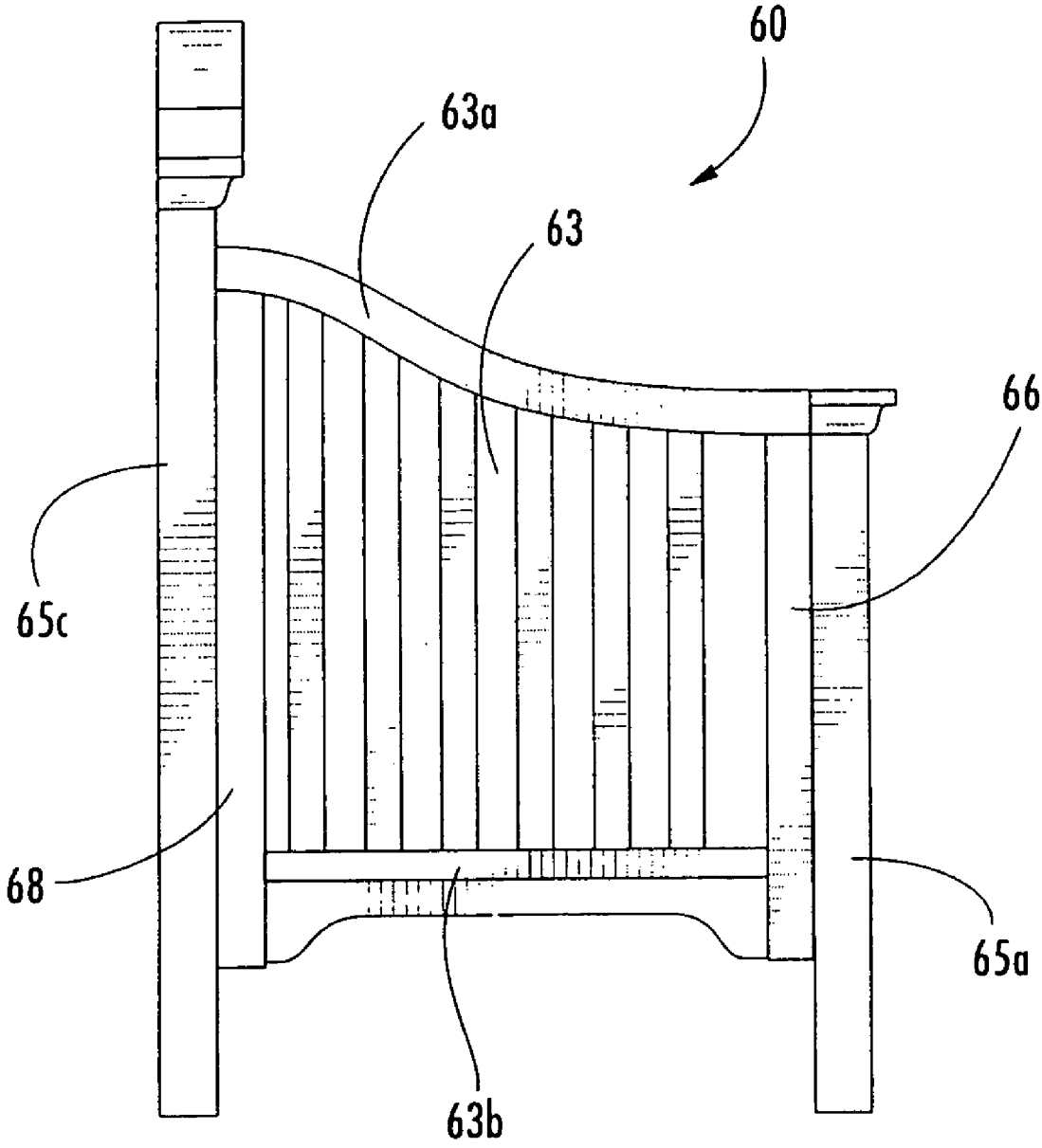
FIG. 13 is a side elevation of a convertible crib according to another preferred embodiment of the invention.
Figure 14A:
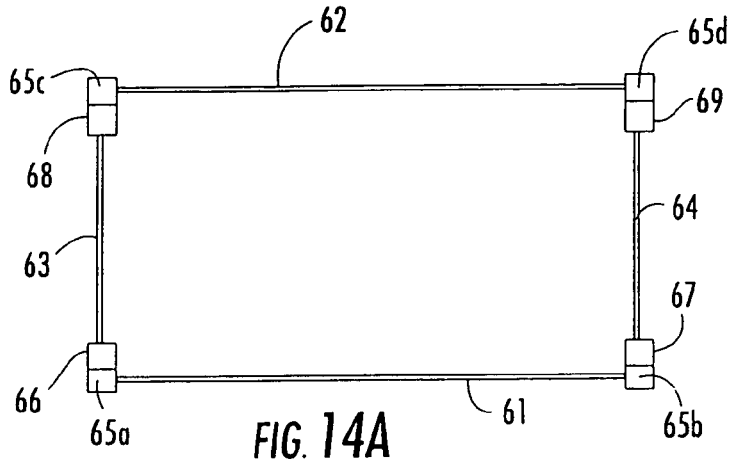
FIG. 14A is a schematic top plan view of the crib of FIG. 13.
Figure 14B:
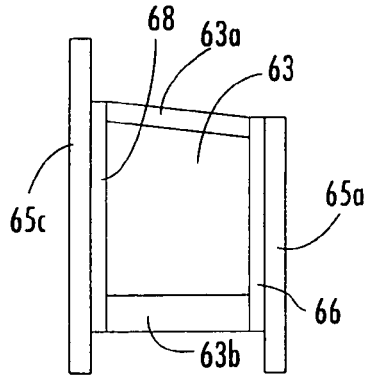
FIG. 14B is a schematic side elevation of the crib of FIG. 13.

Another preferred embodiment of the invention is illustrated in FIG. 13, and shown generally at reference numeral 60. As shown in FIGS. 13, 14A and 14B, the convertible crib 60 comprises a front panel 61, a rear panel 62 and two smaller side panels 63, 64, four legs 65*a* 65*b*, 65*c* and 65*d*, and four stabilizer posts 66, 67, 68 and 69. Side panel 63 includes a horizontally extending top side rail 63*a* and a horizontally extending bottom side rail 63*b* respectively. The other side panel is constructed identically to side panel 63, and therefore is not shown in similar detail. As shown in FIGS. 14A–B , the front legs 65*a*, 65*b* support the front panel 61, and the rear legs 65*c*, 65*d* support the rear panel 62. The stabilizer posts 66–69 are positioned adjacent and parallel to the legs 65*a–d*, respectively. Each leg 65*a–d* is removably engaged to a respective stabilizer post 66–69, by a conventional connecting means, such as nuts and bolts.

Figure 15A:
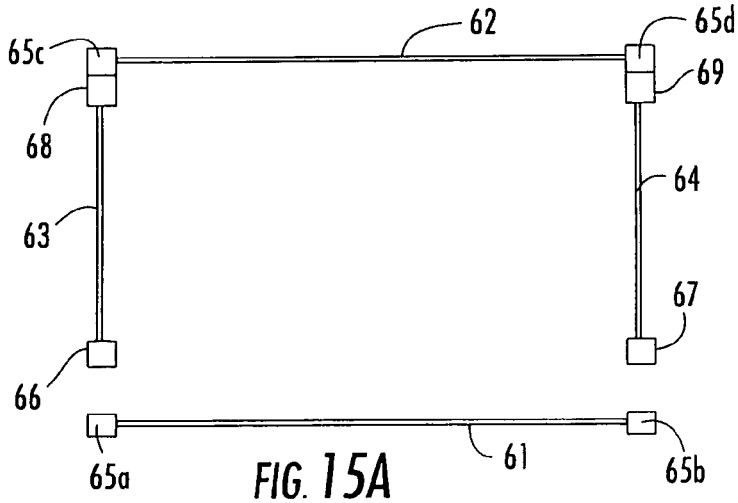
FIG. 15A is a schematic top plan view of the crib of FIG. 13 shown converted into a youth bed.
Figure 15B:
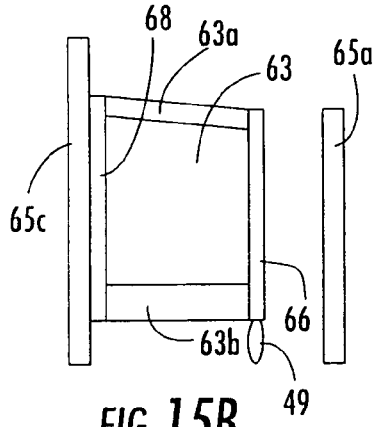
FIG. 15B is a schematic side elevation of the crib of FIG. 13 shown converted into a youth bed.

As shown in FIGS. 15A–B , the crib 60 can be converted into a day bed by disconnecting the front legs 65*a*, 65*b* from stabilizer posts 66, 67 to remove the front panel 61. Foot pieces 49 are positioned under the stabilizer posts 66, 67. In addition, the crib 60 can be converted into a toddler or youth bed by adding a front railing.

Figure 16A:
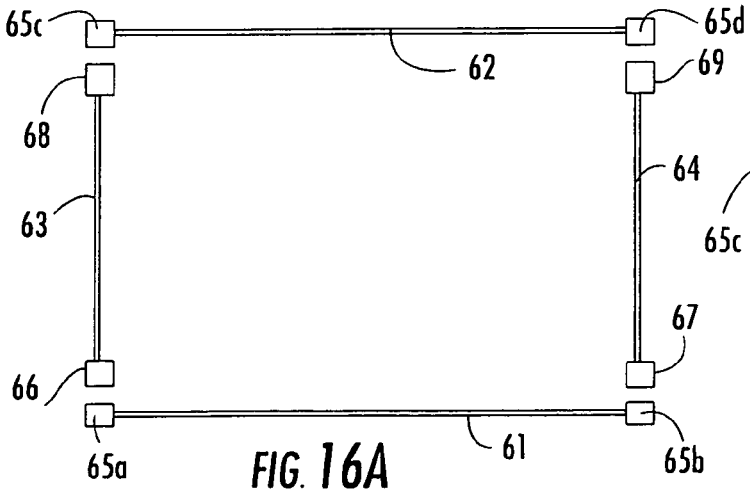
FIG. 16A is schematic top plan view of the crib of FIG. 13 shown converted into a full-size bed and a day bed.
Figure 16B:
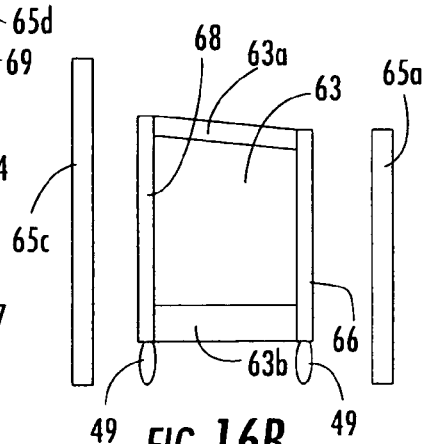
FIG. 16B is schematic side elevation of the crib of FIG. 13 shown converted into a full-size bed and a day bed.
Figure 17:
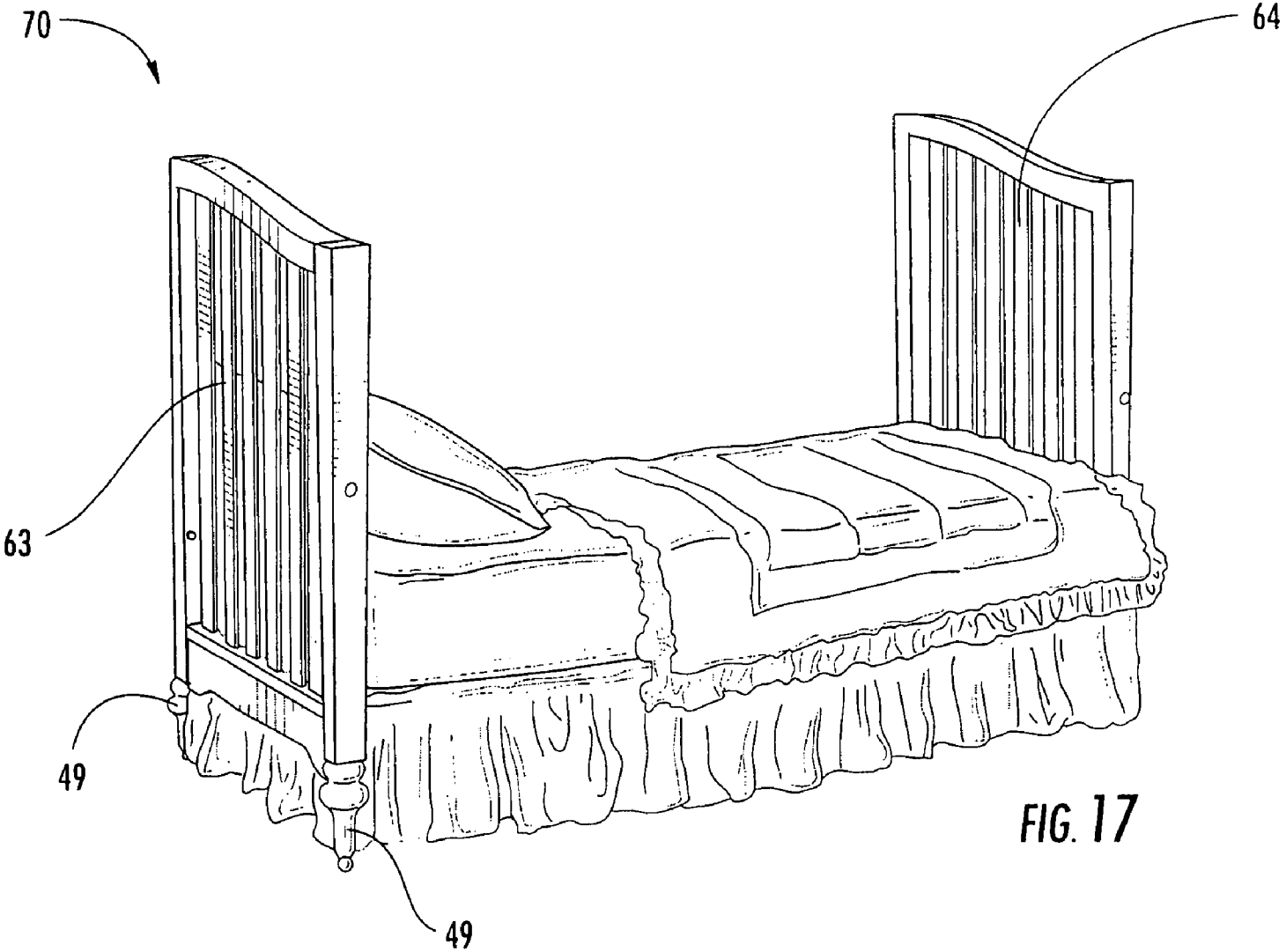
FIG. 17 is a perspective view of the day bed of FIGS. 16A and 16B.

The length of the crib 60 is approximately equal to the width of a full size bed. Therefore, the front panel 61 and the rear panel 62 can be removed from the rest of the crib 60 by disengaging the legs 65*a–d* from the stabilizer posts 66–69, and used as a footboard and headboard, respectively, on a full-size bed as shown in FIG. 16A. Because the stabilizer posts 66–69 are structurally independent of the legs 65*a–d* , the bed of the crib 60 remains stable and standing when the front panel 61 and rear panel 62 are removed, unlike in the prior art. While the front panel 61 and rear panel 62 are used as a footboard and headboard in a full size bed, the remaining parts of the crib 60 form a day bed 70, as shown in FIGS. 16A–B and 17, by positioning foot pieces 49 under all four stabilizer posts 66–69. As such, all structural components of the crib 60 can be utilized at once in two different furniture pieces. Alternatively, the stabilizer posts 66–69 could be full length legs.

Figure 18A:
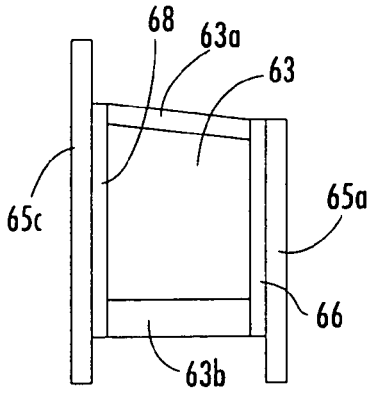
FIGS. 18A–18E are side elevations of five preferred embodiments of the invention.
Figure 18B:
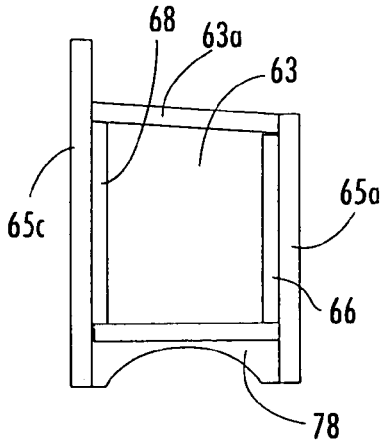
Figure 18C:
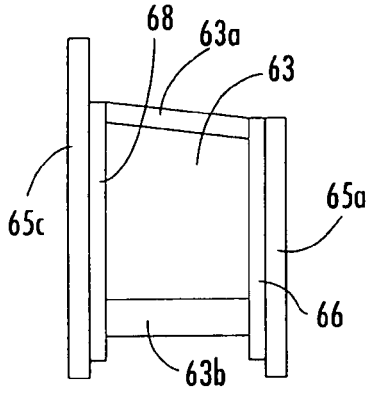

FIGS. 18A–E show various preferred embodiments of the crib according to the invention. FIG. 18B depicts a preferred embodiment in which an arched bottom piece 78 is attached underneath each bottom side rail of the side panels 63, 64 and is flush with the legs 65*a–d* . The arched bottom pieces 78 eliminate the need for foot pieces 49 when legs 65*a–d* are removed.

Figure 18D:
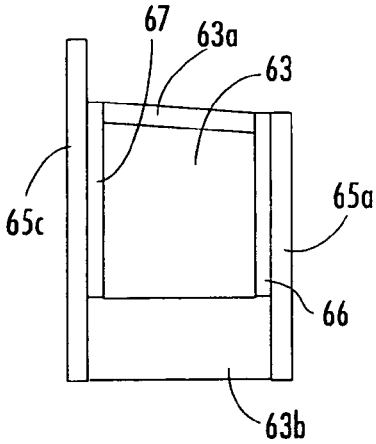

FIG. 18D shows a preferred embodiment in which the bottom side rail 63*a* of side panel 63 is flush with legs 65*a*, 65*c*. Side panel 64 is constructed identically to side panel 63. The flush bottom side rails eliminates the need for foot pieces 49 when the legs 65*a–d* are removed.

Figure 18E:
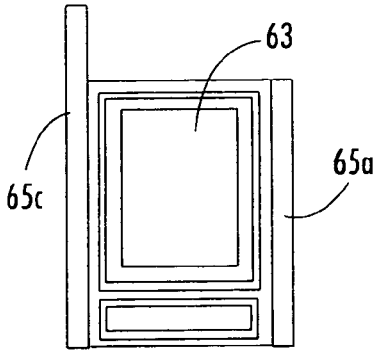
Figure 19A:
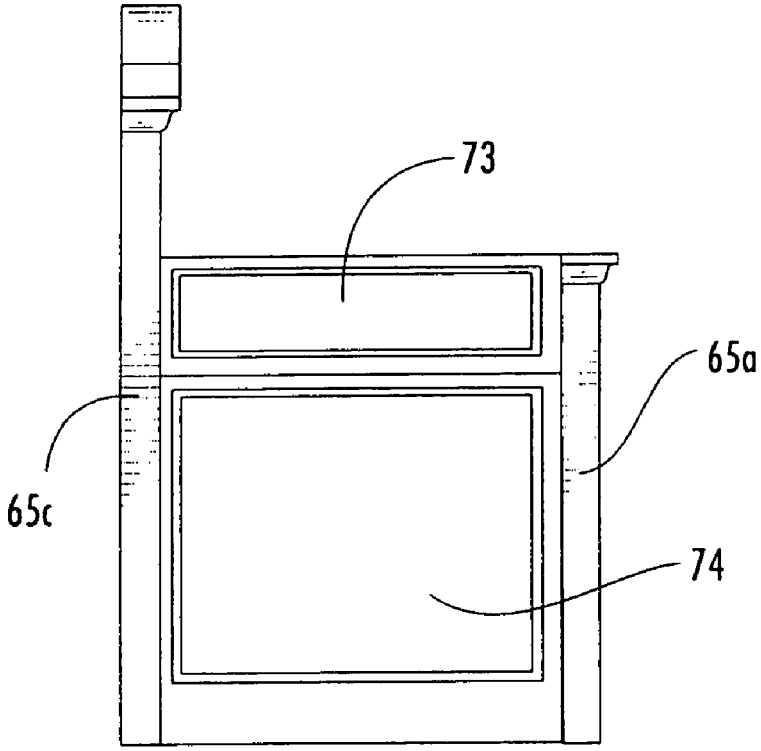
FIG. 19A is a side elevation of a crib according to yet another preferred embodiment of the invention.
Figure 19B:
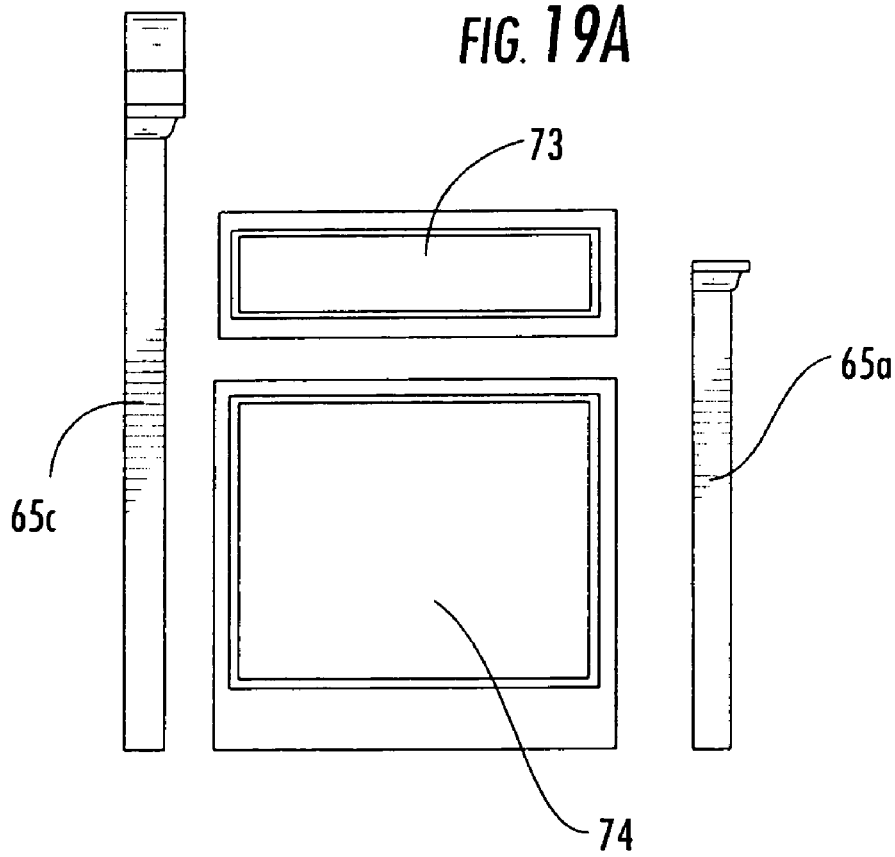
FIG. 19B is an exploded side elevation of the crib of FIG. 19A.

FIG. 18E shows a preferred embodiment in which each side panel 63, 64 comprises a solid panel that is flush with the legs 65*a–d*. FIGS. 19A–B show another preferred embodiment in which each side panel 63, 64 comprises a solid top side panel 73 and a solid lower side panel 74 that is flush with the legs 65*a–d*. The top side panel 73 is removably engaged to the bottom side panel 74 so that when the crib 60 is converted to a day bed or sofa, the top side panel 73 can be removed so that the side panels 63, 64 appear to be in proper proportion.

A convertible crib and methods for using same are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A crib which is convertible to another article of furniture, comprising:

(a) first, second, third and fourth interconnected panels defining an enclosure for supporting a base;

(b) first, second, third and fourth legs for supporting the panels on a surface, the first and second legs supporting the first panel; and (c) first and second stabilizer posts, the first stabilizer post positioned parallel and proximate to the first leg, the second stabilizer post positioned parallel and proximate to the second leg, the first and second stabilizer posts sized to terminate at a point above the surface such that the stabilizer posts do not contact the surface, the first stabilizer post connected to the second panel and the second stabilizer post connected to the third panel, wherein the first leg is releasably connected to the first stabilizer post, and the second leg is releasably connected to the second stabilizer post; and (d) whereby the crib is convertible to another furniture piece by disconnecting the first leg from the first stabilizer post and disconnecting the second leg from the second stabilizer post to remove the first panel, and positioning a base piece under the stabilizer posts whereby the second, third and fourth panels are supported on the surface when the first and second legs are removed.

2. A crib according to claim 1, wherein the crib is convertible to at least one other article of furniture selected from the group consisting of a day bed, a youth bed, a full size bed and a sofa.

3. A crib according to claim 1, wherein the first panel is adapted for use as a component on another article of furniture when removed from the crib, whereby all parts of the crib are utilized.

4. A crib according to claim 1, wherein the first panel defines a front panel, the second panel defines a rear panel, the third panel defines a left side panel, and the fourth panel defines a right side panel, and further wherein the crib is converted to a day bed by disconnecting the first and second panels from the stabilizer posts.

5. A crib according to claim 4, wherein the crib has a length approximately equal to a width of a full size bed, and the first panel is adapted to serve as a footboard for a full size bed when disconnected from the first and second legs whereby all components of the crib are utilized when the crib is converted to a day bed.

6. A crib according to claim 1, wherein the base piece comprises first and second foot pieces for releasably connecting to bottom sides of the first and second stabilizer posts, the foot pieces sized to terminate at the surface when connected to the stabilizer posts, whereby the stabilizer posts and the foot pieces support the second and third panels on the surface when the first and second legs are disconnected from the stabilizer posts.

7. A crib according to claim 1, further comprising a front railing for connecting to the stabilizer posts when the first and second legs are disconnected from the stabilizer posts whereby the crib is converted to a youth bed.

8. A crib which is convertible to another article of furniture, comprising:

(a) front, rear, left and right interconnected panels defining an enclosure for positioning a base;

(b) first, second, third, and fourth primary support members for supporting the base, the primary support members connected to the left and right panels;

(c) first, second, third and fourth secondary support members releasably connected to the first, second, third and fourth primary support members, respectively, the secondary support members connected to the front and rear panels;

(d) whereby the crib is convertible to another furniture piece by disconnecting the first, second, third and fourth secondary support members from the first, second, third and fourth primary supports whereby the front and rear panels are removed and the left and right panels are supported on a surface by the primary support members.

9. A crib according to claim 8, wherein the crib is convertible to at least one other furniture piece selected from the group consisting of a day bed, a youth bed, a full size bed and a sofa.

10. A crib according to claim 8, wherein:

(a) the primary support members comprise first, second, third and fourth stabilizer posts; and (b) the secondary support members comprise first, second, third and fourth legs, wherein the first, second, third and fourth legs are releasably connected to the first, second, third and fourth stabilizer posts, respectively, whereby the crib is convertible to another furniture piece by disconnecting the legs from the stabilizer posts to remove the front and rear panels, whereby the left and right panels are supported on the surface when the legs are removed.

11. A crib according to claim 10, wherein the crib is convertible to at least one other furniture piece selected from the group consisting of a day bed, a youth bed, a full size bed and a sofa, and further wherein all components of the crib can be simultaneously utilized in two different furniture pieces.

12. The crib according to claim 10, wherein the crib has a length approximately equal to a width of a bed, and the front panel is adapted to serve as a footboard for a bed when disconnected from the stabilizer posts, the rear panel is adapted for use as a headboard for the bed when disconnected from the stabilizer posts, whereby all components of the crib are utilized when the crib is converted to another article of furniture.

13. A crib according to claim 10, wherein the crib is converted into a day bed when the legs are disconnected from the stabilizer posts.

14. A crib according to claim 13, further comprising a railing for connecting to the first and second stabilizer posts to convert the day bed to a youth bed.

15. A crib according to claim 10, further comprising first, second, third and fourth foot pieces for releasably connecting to bottom sides of the first, second, third and fourth stabilizer posts, respectively, the foot pieces sized to terminate at the surface when connected to the stabilizer posts, whereby the stabilizer posts and the foot pieces support the left and right panels on the surface when the legs are disconnected from the stabilizer posts.

16. A method for converting a crib to another furniture piece comprising the steps of:

(a) providing a crib which is convertible to another article of furniture, comprising:

(i) first, second, third and fourth interconnected panels defining an enclosure for positioning a base, (ii) first, second, third and fourth legs for supporting the panels on a surface, the first and second legs supporting the first panel, (iii) first and second stabilizer posts, the first stabilizer post releasably connected to the first leg, the second stabilizer post releasably connected to the second leg, the first and second stabilizer posts each sized to terminate at a point above the surface whereby the stabilizer posts do not contact the surface, and (iv) wherein the first stabilizer post is connected to the second panel, the second stabilizer post is connected to the third panel, and the first leg and the second leg are connected to the first panel;

(b) disconnecting the first leg from the first stabilizer post and disconnecting the second leg from the second stabilizer post to remove the first panel;

(c) positioning foot pieces on the first and second stabilizer posts, the foot pieces sized to terminate at the surface when connected to the stabilizer posts, whereby the second, third and fourth panels are supported on the surface.

17. A method according to claim 16, wherein the crib further comprises a third stabilizer post releasably connected to the third leg, and a fourth stabilizer post releasably connected to the fourth leg, and the third leg and fourth leg are connected to the fourth panel, and further comprising the step of disconnecting the third leg from the third stabilizer post and the fourth leg from the fourth stabilizer post to remove the fourth panel from the crib.

18. A method according to claim 17, further including the steps of:

(a) using the removed first panel as a footboard for a bed; and (b) using the removed fourth panel as a headboard for a bed.

19. A method according to claim 16, further including the step of converting the crib into at least one other furniture piece selected from the group consisting of a day bed, a youth bed, a full size bed and a sofa.

* * * * *